United States Patent [19]

Giannetti et al.

[11] 4,192,653

[45] Mar. 11, 1980

[54] NOVEL FUEL COMPOSITIONS COMPRISING UPGRADED SOLID AND/OR SEMI-SOLID MATERIAL PREPARED FROM COAL

[75] Inventors: Joseph P. Giannetti, Allison Park; Harold E. Swift, Gibsonia, both of Pa.

[73] Assignee: Gulf Research and Development Company, Pittsburgh, Pa.

[21] Appl. No.: 865,607

[22] Filed: Dec. 29, 1977

[51] Int. Cl.[2] ..... C10L 1/00; C10G 1/06

[52] U.S. Cl. ..... 44/51; 208/8 LE; 208/10; 44/1 A

[58] Field of Search ..... 44/51, 1 A; 208/8 LE, 208/10

[56] References Cited

U.S. PATENT DOCUMENTS

| | | | |
|---|---|---|---|
| 3,184,401 | 5/1965 | Gorin | 208/8 LE |
| 3,642,608 | 2/1972 | Roach | 44/51 |
| 4,018,663 | 4/1977 | Karr, Jr. | 208/10 |
| 4,083,769 | 4/1978 | Hildebrand et al. | 208/10 |

*Primary Examiner*—Winston A. Douglas
*Assistant Examiner*—J. V. Howard

[57] ABSTRACT

Novel fuel compositions comprising: (A) A solid and/or semi-solid material formed by a process for upgrading coal which comprises the steps of: (1) subjecting a slurry composed of coal and a solvent containing donatable hydrogen, together with hydrogen, to catalyst-free hydrogenation conditions in a first hydrogenation zone to form an intermediate coal-solvent slurry; (2) deashing said intermediate coal-solvent slurry to form a coal-solvent solution; (3) subjecting said coal-solvent solution to catalytic hydrogenation conditions in a second hydrogenation zone to obtain a product that can be separated at ambient pressure into (a) a first liquid fraction boiling at a temperature in the range of about 100° to about 375° C., (b) a second liquid fraction boiling above said first liquid fraction at a temperature in the range of about 200° to about 525° C. and (c) said solid and/or semi-solid material; and then (4) recycling at least a portion of said second liquid fraction to said first hydrogention zone; and (B) a light-boiling hydrocarbon stock boiling at a temperature in the range of about 100° to about 375° C. at ambient pressure; wherein the weight ratio of said solid and/or semi-solid material to said light-boiling hydrocarbon stock is about 20:1 to about 1.5:1.

12 Claims, No Drawings

NOVEL FUEL COMPOSITIONS COMPRISING UPGRADED SOLID AND/OR SEMI-SOLID MATERIAL PREPARED FROM COAL

BACKGROUND OF THE INVENTION

1. Field of the Invention

A solvent refined coal product is a solid and/or semi-solid material that cannot be converted readily to a fuel of lower viscosity (ca 220 Saybolt Furol Seconds at 99° C.) unless it is blended with a large amount of light-boiling hydrocarbon stock or subjected to hydrogenation. The latter has the disadvantage of requiring large amounts of hydrogen. Both these alternatives are costly.

The present invention is directed to novel fuel compositions comprising: (A) a solid and/or semi-solid material formed by a process for upgrading coal which comprises the steps of: (1) subjecting a slurry composed of coal and a solvent containing donatable hydrogen, together with hydrogen, to catalyst-free hydrogenation conditions in a first hydrogenation zone to form an intermediate coal-solvent slurry; (2) deashing said intermediate coal-solvent slurry to form a coal-solvent solution; (3) subjecting said coal-solvent solution to catalytic hydrogenation conditions in a second hydrogenation zone to obtain a product that can be separated at ambient pressure into (a) a first liquid fraction boiling at a temperature in the range of about 100° to about 375° C,. (b) a second liquid fraction boiling above said first liquid fraction at a temperature in the range of about 200° to about 525° C. and (c) said solid and/or semi-solid material; and then (4) recycling at least a portion of said second liquid fraction to said first hydrogenation zone; and (B) a light-boiling hydrocarbon stock boiling at a temperature in the range of about 100° to about 375° C. at ambient pressure; wherein the weight ratio of said solid and/or semi-solid material to said light-boiling hydrocarbon stock is about 20:1 to about 1.5:1.

2. Description of the Prior Art

Applicant is unaware of any prior art relevant to the invention defined and claimed herein.

SUMMARY OF THE INVENTION

We have discovered novel fuel compositions comprising: (A) a solid and/or semi-solid material formed by a process for upgrading coal which comprises the steps of: (1) subjecting a slurry composed of coal and a solvent containing donatable hydrogen, together with hydrogen, to catalyst-free hydrogenation conditions in a first hydrogenation zone to form an intermediate coal-solvent slurry; (2) deashing said intermediate coal-solvent slurry to form a coal-solvent solution; (3) subjecting said coal-solvent solution to catalytic hydrogenation conditions in a second hydrogenation zone to obtain a product that can be separated at ambient pressure into (a) a first liquid fraction boiling at a temperature in the range of about 100° to about 375° C,. (b) a second liquid fraction boiling above said first liquid fraction at a temperature in the range of about 200° to about 525° C. and (c) said solid and/or semi-solid material; and then (4) recycling at least a portion of said second liquid fraction to said first hydrogenation zone; and (B) a light-boiling hydrocarbon stock boiling at a temperature in the range of about 100° to about 375° C. at ambient pressure; wherein the weight ratio of said solid and/or semi-solid material to said light-boiling hydrocarbon stock is about 20:1 to about 1.5:1.

The solid and/or semi-solid component of the novel fuel compositions claimed herein is formed by a process described in our copending application entitled "Improved Solvent Refined Coal Process" (Case A), Ser. No. 865,605, filed concurrently herewith. In general, as defined in said application, a slurry composed of coal and a solvent containing donatable hydrogen, together with hydrogen, is subjected to catalyst-free hydrogenation conditions in a first hydrogenation zone under the conditions set forth in Table 1.

Table 1

| Catalyst-Free Hydrogenation Conditions | | |
|---|---|---|
| | Broad Range | Preferred Range |
| Temperature, °C. | 343–510 | 399–482 |
| Pressure, kPa (psig)[1] | 3,447–34,470 (500–5,000) | 6,894–13,888 (1,000–2,000) |
| Solvent/Coal Weight Ratio | 0.5/1–10/1 | 1/1–4/1 |
| Hydrogen/Coal Feed Weight Ratio | 0.01/1–0.30/1 | 0.05/1–0.10/1 |
| Hydrogen Gas Purity, mole % | 85–100 | 95–97 |
| Residence Time, hrs | 0.1–5.0 | 0.5–2.0 |

[1]kilopascals (pounds per square inch gauge)

After subjecting the slurry to catalyst-free hydrogenation conditions, an intermediate coal-solvent slurry is obtained. Ash and/or other insoluble material is separated from the intermediate coal-solvent slurry and a coal-solvent solution is obtained. The coal-solvent solution formed as the result of deashing is subjected to catalytic hydrogenation conditions in a second hydrogenation zone. The catalytic hydrogenation conditions are set forth in Table 2.

Table 2

| Catalytic Hydrogenation Conditions | | |
|---|---|---|
| | Broad Range | Preferred Range |
| Temperature, ° C. | 260–538 | 399–454 |
| Pressure, kPa (psig) | 3,447–68,940 (500–10,000) | 6,894–27,576 (1,000–4,000) |
| Liquid Hourly Space Velocity, volume feed/volume catalyst/hr | 0.3–10 | 1.0–4 |
| Hydrogen Flow Rate, kmol $H_2/m^3$ feed | 25–190 | 60–90 |

Any hydrogenation catalyst suitable for use in coal hydrogenation can be used herein, for example, the catalyst defined and claimed in U.S. Pat. No. 3,840,423. The preferred catalyst is comprised of a hydrogenation component selected from the group consisting of Group VI and Group VIII metals, their oxides and sulfides, supported on a non-zeolitic carrier, which catalyst is promoted with a Group IV-B metal. Illustrative of particularly preferred catalysts for use in our invention have metal combinations of nickel-titanium-molybdenum, nickel-cobalt-molybdenum, and nickel-tungsten on an alumina carrier.

Catalytic hydrogenation produces a product that can be separated by any conventional method known in the art, especially by distillation at ambient pressure into (a) a first liquid fraction boiling at a temperature in the range of about 100° to about 375° C., preferably about 150° to about 325° C., (b) a second liquid fraction boiling above said first liquid fraction at a temperature in the range of about 200° to about 525° C., preferably about 250° to about 475° C., and (c) a solid and/or semi-solid material. An elemental analysis for a typical solid and/or semi-solid material obtained by the process described in said copending application and which is a necessary component of the novel fuel compositions claimed herein is set forth in Table 3.

Table 3

| | Analysis of the Solid and/or Semi-Solid Material | |
|---|---|---|
| | Broad Range, wt % | Preferred Range, wt % |
| Carbon | 87.0–93.0 | 88.0–92.0 |
| Hydrogen | 5.5–9.5 | 6.5–8.0 |
| Nitrogen | 0.3–3.0 | 0.8–2.0 |
| Oxygen | 0.0–1.5 | 0.1–1.0 |
| Sulfur | 0.0–0.5 | 0.0–0.2 |

The solid and/or semi-solid material is capable of being blended with a light-boiling hydrocarbon stock boiling at a temperature in the range of about 100° to about 375° C., preferably at about 150° to about 325° C., at ambient pressure. A typical elemental analysis for a light-boiling hydrocarbon stock is set forth in Table 4.

Table 4

| | Analysis of Light-Boiling Hydrocarbon Stock | |
|---|---|---|
| | Broad Range, wt % | Preferred Range, wt % |
| Carbon | 85.0–93.0 | 88.0–91.0 |
| Hydrogen | 7.0–12.0 | 8.5–11.0 |
| Nitrogen | 0.0–2.0 | 0.1–0.7 |
| Oxygen | 0.0–2.0 | 0.1–0.7 |
| Sulfur | 0.0–3.0 | 0.0–0.3 |

In general, suitable light-boiling hydrocarbon stocks that can be employed in the invention can include, for example, #2 fuel oil, kerosene, jet fuel, diesel fuel, gasoline, light shale oil fractions and light fractions obtained from coal hydrogenation. A particularly preferred light-boiling hydrocarbon stock is described in said copending application and in the present invention herein as "a first liquid fraction boiling at a temperature in the range of about 100° to about 375° C., preferably about 150° to about 375° C. An elemental analysis of said first liquid fraction is set forth in Table 5 herein.

Table 5

| | Analysis of the First Liquid Fraction | |
|---|---|---|
| | Broad Range, wt % | Preferred Range, wt % |
| Carbon | 87.0–93.0 | 88.0–91.0 |
| Hydrogen | 7.0–12.0 | 8.5–11.0 |
| Nitrogen | 0.0–2.0 | 0.1–0.7 |
| Oxygen | 0.0–2.0 | 0.1–0.7 |
| Sulfur | 0.0–0.5 | 0.0–0.3 |

The solid and/or semi-solid material is mixed or blended with the light-boiling hydrocarbon stock by means well-known in the art. The ingredients are mixed until a homogeneous product is obtained. The weight ratio of said solid and/or semi-solid material to said light-boiling hydrocarbon stock is about 20:1 to about 1.5:1, preferably about 10:1 to about 2:1. An elemental analysis of said homogeneous product is set forth in Table 6.

Table 6

| | Product Analysis | |
|---|---|---|
| | Broad Range, wt % | Preferred Range, wt % |
| Carbon | 87.0–93.0 | 88.0–91.5 |
| Hydrogen | 5.0–11.0 | 6.0–9.0 |

Table 6-continued

| | Product Analysis | |
|---|---|---|
| | Broad Range, wt % | Preferred Range, wt % |
| Nitrogen | 0.5–2.0 | 0.8–1.5 |
| Oxygen | 0.1–3.0 | 0.2–1.5 |
| Sulfur | 0.0–0.5 | 0.0–0.2 |

The product obtained as a result of the invention described herein is useful as a fuel for power generation in place of fuel oil derived from coal and petroleum stocks.

DESCRIPTION OF PREFERRED EMBODIMENTS

The invention will be further described with reference to the experimental data.

EXAMPLE 1

An ash-containing coal from the Pittsburg and Midway Coal Company Colonial Mine was used in the experimental work. The coal had the following analysis:

Table 7

| | Ash-Containing Coal Analysis (Dry Basis) |
|---|---|
| | wt % |
| Carbon | 71.8 |
| Hydrogen | 5.0 |
| Nitrogen | 1.3 |
| Oxygen | 7.9 |
| Sulfur | 3.7 |
| Ash | 10.3 |

The coal was dissolved in a solvent substantially as defined in Table 6 in our said copending application, together with hydrogen, under catalyst-free hydrogenation conditions set forth in Table 8 in a first hydrogenation zone to form an intermediate coal-solvent slurry.

Table 8

| Catalyst-Free Conditions | |
|---|---|
| Temperature, ° C. | 450 |
| Pressure, kPa (psig) | 10,755 (1560) |
| Solvent/Coal Weight Ratio | 2.14/1 |
| Hydrogen/Coal Feed Weight Ratio | 0.08/1 |
| Residence Time, hrs | 1 |

Ash and/or other insolubles were separated from the coal-solvent slurry by filtration under the conditions set forth in Table 9 to form a coal-solvent solution. An analysis of the coal-solvent solution is set forth in Table 10.

Table 9

| Filtration Conditions | |
|---|---|
| Filter Temperature, ° C. | 229 |
| Filter Pressure, kPa (psig) | 1206 (175) |
| Pressure Drop, kPa (psig) | 207 (30) |
| Knife Advance, mil/min | 1 |
| Drum Speed, min/revolution | 1.0–1.5 |
| Basecoat | Fibra F10-11C and Celite 545 |
| Precoat | Celite 535 |

Table 10

| | Coal-Solvent Solution Analysis |
|---|---|
| | wt % |
| Carbon | 89.3 |

Table 10-continued

| Coal-Solvent Solution Analysis | wt % |
|---|---|
| Hydrogen | 6.3 |
| Nitrogen | 1.2 |
| Oxygen | 2.5 |
| Sulfur | 0.7 |
| Ash | 0.04 |

The coal-solvent solution was subjected to catalytic hydrogenation by passing the solution over a specific catalyst under specific reaction conditions set forth in Table 11 to form a product.

Table 11

| Catalyst Composition and Reaction Conditions | |
|---|---|
| Catalyst[1] | 0.5 wt % nickel<br>1.0 wt % cobalt<br>8.0 wt % molybdenum |
| Temperature, ° C. | 427 |
| Pressure, kPa (psig) | 20,700 (3,000) |
| Liquid Hourly Space Velocity, ml feed/ml catalyst/hr | 2.0 |
| Hydrogen Flow Rate, kmol $H_2/m^3$ feed | 75.2 |

[1]The metals were deposited on alumina having a surfacearea of 185 $m^2/g$, a pore diameter of 188 A and a porevolume of 0.66 cc/gm.

The product was subjected to separation by distillation after catalytic hydrogenation into (a) a first liquid fraction which boiled between about 191° to about 288° C., (b) a second liquid fraction that boiled between about 288° to about 396° C. and (c) a solid and/or semi-solid material. An analysis of each of these is set forth in Table 12.

Table 12

| Liquid Fractions and Solid and/or Semi-Solid Analyses | | wt % |
|---|---|---|
| First Liquid Fraction (191° to 288° C.) | Carbon | 89.3 |
| | Hydrogen | 9.8 |
| | Nitrogen | 0.4 |
| | Oxygen | 0.4 |
| | Sulfur | 0.06 |
| Second Liquid Fraction (288° to 403° C.) | Carbon | 90.6 |
| | Hydrogen | 8.1 |
| | Nitrogen | 0.5 |
| | Oxygen | 0.4 |
| | Sulfur | 0.1 |
| Solid and/or Semi-Solid Material | Carbon | 89.3 |
| | Hydrogen | 7.0 |
| | Nitrogen | 1.3 |
| | Oxygen | 0.8 |
| | Sulfur | 0.1 |

The solid and/or semi-solid material defined in Table 12 was blended with a light-boiling hydrocarbon stock which has been defined as the first liquid fraction in Table 12. The blends had the characteristics set forth in Table 13.

Table 13

| Blends of Solid and/or Semi-Solid Material and First Liquid Fraction | Blead No. 1 | Blend No. 2 |
|---|---|---|
| Solid and/or Semi-Solid Material: wt % (A) | 82 | 75 |
| First Liquid: wt % Fraction (B) | 18 | 25 |
| Ratio A/B | 4.6 | 3.0 |
| Viscosity: Saybolt Furol Seconds at 99° C. | 180 | 58 |

Table 13-continued

| Blends of Solid and/or Semi-Solid Material and First Liquid Fraction | wt % | wt % |
|---|---|---|
| Carbon | 89.3 | 89.3 |
| Hydrogen | 7.5 | 8.2 |
| Nitrogen | 1.1 | 1.1 |
| Oxygen | 0.7 | 0.7 |
| Sulfur | 0.1 | 0.1 |

EXAMPLE 2

This example is identical to Example 1 except that the catalytic hydrogenation conditions were as follows:

| | |
|---|---|
| Temperature, ° C. | 427 |
| Pressure, kPa (psig) | 10,300 (1,500) |
| Liquid Hourly Space Velocity, ml feed/ml catalyst/hr | 2 |
| Hydrogen Flow Rate, kmol $H_2/m^3$ feed | 75.2 |

and the weight ratio of solid and/or semi-solid material (boiling above 454° C.) to the light-boiling hydrocarbon stock was 2.7:1. The final product obtained had the characteristics set forth in Table 14.

Table 14

| Blend of Solid and/or Semi-Solid Material and First Liquid Fraction | Blend No. 3 |
|---|---|
| Solid and/or Semi-Solid Material, wt % (A) | 73 |
| First Liquid Fraction, wt % (B) | 27 |
| Viscosity: Saybolt Furol Seconds at 99° C. | 75 |

| | wt % |
|---|---|
| Carbon | 90.8 |
| Hydrogen | 7.1 |
| Oxygen | 1.3 |
| Nitrogen | 1.3 |
| Sulfur | 0.1 |

EXAMPLE 3

This example is identical to Example 1 except that the catalytic hydrogenation conditions were as follows:

| | |
|---|---|
| Temperature, ° C. | 427 |
| Pressure, kPa (psig) | 20,700 (3,000) |
| Liquid Hourly Space Velocity, ml feed/ml catalyst/hr | 1 |
| Hydrogen Flow Rate, kmol $H_2/m^3$ feed | 75.2 |

The solid and/or semi-solid material (boiling above 389° C.) was blended with the first liquid fraction. The blends had the characteristics set forth in Table 15.

Table 15

| Blend of Solid and/or Semi-Solid Material and First Liquid Fraction | Blend No. 4 | Blend No. 5 | Blend No. 6 |
|---|---|---|---|
| Solid and/or Semi-Solid Material, wt % (A) | 89 | 87 | 82 |
| First Liquid Fraction, wt % (B) | 11 | 13 | 18 |
| Ratio A/B | 8.1 | 6.7 | 4.6 |
| Viscosity, Saybolt Furol Seconds | | | |

Table 15-continued

| Blend of Solid and/or Semi-Solid Material and First Liquid Fraction | | | |
|---|---|---|---|
| at 99° C. | 180 | 70 | 30 |
| | wt % | wt % | wt % |
| Carbon | 89.6 | 89.6 | 89.6 |
| Hydrogen | 7.6 | 7.6 | 7.8 |
| Nitrogen | 1.2 | 1.2 | 1.1 |
| Oxygen | 0.4 | 0.4 | 0.4 |
| Sulfur | <0.04 | <0.04 | <0.04 |

Obviously, many modifications and variations of the invention, as hereinabove set forth, can be made without departing from the spirit and scope thereof, and, therefore, only such limitations should be imposed as are indicated in the appended claims.

We claim:

1. Novel fuel compositions comprising:

(A) a solid and/or semi-solid material formed by a process for producing an upgraded material which is solid and/or semi-solid at room temperature having a substantially lower ash, sulfur and nitrogen content from coal containing from about 0.1 to about 30 weight percent ash, from about 0.25 to about 2.5 weight percent nitrogen and from about 0.3 to about 10 weight percent sulfur consisting essentially in the steps of (1) subjecting a slurry composed of said coal containing ash, nitrogen and sulfur and a solvent containing donatable hydrogen, together with hydrogen, to substantially catalyst-free hydrogenation conditions in a first hydrogenation zone wherein the temperature is in the range of about 343° to about 510° C., the pressure is in the range of about 500 to about 5000 psig, the solvent to coal weight ratio is in the range of about 0.5/1 to about 10/1, the hydrogen/coal feed weight ratio is in the range of about 0.01 to about 0.30/1, the hydrogen gas purity is in the range of about 85 to about 100 mole percent and the residence time is in the range of about 0.1 to about 5.0 hours, to form an intermediate coal-solvent slurry; (2) deashing said intermediate coal-solvent slurry to form a coal-solvent solution, said coal-solvent solution being such that in the absence of solvent therein at ambient temperature and pressure left behind would be deashed coal; (3) subjecting said coal-solvent solution to catalytic hydrogenation in a second hydrogenation zone in the presence of a catalyst consisting essentially of nickel, titanium and molybdenum wherein the temperature is in the range of about 260° to about 538° C., the pressure is in the range of about 500 to about 10,000 psig, the liquid hourly space velocity is in the range of about 0.3 to about 10 volume feed/volume catalyst/hour and the hydrogen flow rate is in the range of about 25 to about 190 kmol $H_2/m^3$ feed to obtain a liquid product, (4) separating said liquid product to obtain (a) said desired upgraded material which is solid and/or semi-solid at room temperature having a substantially lower ash, sulfur and nitrogen content than the coal charge, (b) a first liquid fraction boiling at a temperature in the range of about 100° to about 375° C. and (c) a second liquid fraction boiling above said first liquid fraction at a temperature in the range of about 200° to about 525° C.; and then (5) recycling at least a portion of said second liquid fraction to said first hydrogenation zone; and (B) a light-boiling hydrocarbon stock boiling at a temperature in the range of about 100° to about 375° C. at ambient pressure.

2. Novel fuel compositions according to claim 1 wherein in said first hydrogenation zone the temperature is in the range of about 399° to about 482° C., the pressure is in the range of about 1000 to about 2000 psig, the solvent/coal weight ratio is in the range of about 1/1 to about 4/1, the hydrogen/coal feed weight ratio is in the range of about 0.05/1 to about 0.10/1, the hydrogen gas purity is in the range of about 95 to about 97 mole percent and the residence time is in the range of about 0.5 to about 2.0 hours and wherein in said second hydrogenation zone the temperature is in the range of about 399° to about 454° C., the pressure is in the range of about 1000 to about 4000 psig, the liquid space velocity is in the range of about 1.0 to about 4 volume feed/volume catalyst/hour and the hydrogen flow rate is in the range of about 60 to about 90 kmol $H_2/m^3$ feed.

3. Novel fuel compositions according to claim 1 wherein said first liquid fraction boils at a temperature in the range of about 150° to about 325° C.; and said second fraction boiling above said first liquid fraction boils at a temperature in the range of about 250° to about 475° C.

4. Novel fuel composition according to claim 1 wherein a weight ratio of said solid and/or semi-solid material to said light-boiling hydrocarbon stock is about 20:1 to about 1.5:1.

5. Novel fuel compositions according to claim 1 wherein a weight ratio of said solid and/or semi-solid material to said light-boiling hydrocarbon stock is about 10:1 to about 2:1.

6. Novel fuel compositions according to claim 1 wherein said deashing is by filtration.

7. Novel fuel compositions according to claim 1 wherein said liquid product is separated by distillation.

8. Novel fuel compositions according to claim 1 wherein a portion of ash obtained from said intermediate coal solvent slurry in step 2 is recycled to said first hydrogenation zone.

9. Novel fuel compositions according to claim 1 wherein said light-boiling hydrocarbon stock boils at a temperature in a range of about 150° to about 325° C. at ambient pressure.

10. Novel fuel compositions according to claim 1 wherein said light-boiling hydrocarbon stock is selected from the group consisting of #2 fuel oil, kerosene, jet fuel, diesel fuel, heavy gasoline, light shale oil fractions and light fractions obtained from coal hydrogenation.

11. Novel fuel compositions according to claim 1 wherein said light-boiling hydrocarbon stock is a first liquid fraction boiling at a temperature ranging from about 100° to about 375° C.

12. Novel fuel compositions according to claim 1 wherein said light-boiling hydrocarbon stock is a first liquid fraction boiling at a temperature ranging from about 150° to about 375° C.

* * * * *